US006907682B2

(12) United States Patent
Alfond et al.

(10) Patent No.: US 6,907,682 B2
(45) Date of Patent: Jun. 21, 2005

(54) HORSESHOE-SHAPE BOWLING SHOE HEEL

(75) Inventors: William Alfond, Boston, MA (US); Charles H. Lewia, Skowhegan, ME (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 09/991,101

(22) Filed: Nov. 21, 2001

(65) Prior Publication Data

US 2002/0078601 A1 Jun. 27, 2002

Related U.S. Application Data

(60) Provisional application No. 60/257,812, filed on Dec. 21, 2000.

(51) Int. Cl.[7] ..... A43B 5/00

(52) U.S. Cl. ..... 36/130; 36/34 R; 36/15; 36/100; 36/42

(58) Field of Search ..... 36/130, 34 R, 36/24.5, 15, 100, 42

(56) References Cited

U.S. PATENT DOCUMENTS

| | | | | |
|---|---|---|---|---|
| D31,497 | S | * 9/1899 | Rystrom | D2/964 |
| D48,042 | S | 10/1915 | Phillips | |
| 1,387,988 | A | * 8/1921 | Kaplan | 36/59 C |
| D59,807 | S | 11/1921 | Altruda | |
| 1,395,958 | A | 11/1921 | Hamilton | |
| 1,464,365 | A | 8/1923 | Koetter | |
| 1,490,110 | A | * 4/1924 | Hubbard | 36/34 R |
| 1,580,475 | A | 4/1926 | Farnan | |
| D97,311 | S | * 10/1935 | Troy | D2/923 |
| 2,300,091 | A | 10/1942 | Barry | |
| 2,640,283 | A | 6/1953 | McCord | |
| 3,011,272 | A | * 12/1961 | Goldenberg | 36/130 |
| 3,027,661 | A | 4/1962 | McCord | |
| 3,041,746 | A | 7/1962 | Rakus | |
| 3,063,169 | A | 11/1962 | Cortina | |
| 3,068,592 | A | 12/1962 | Antelo | |

(Continued)

FOREIGN PATENT DOCUMENTS

| | | |
|---|---|---|
| EP | 510 384 | 10/1992 |
| GB | 19561 | 11/1891 |
| GB | 302111 | 11/1891 |
| GB | 23401 | 11/1905 |
| GB | 2 159 038 | 11/1985 |

OTHER PUBLICATIONS

"Self–Adhering Nylon Tapes"; Maurice Gersham, M.D.; Oct. 18, 1959; Journal of A.M.A.; vol. 168, No. 7.

*Primary Examiner*—Ted Kavanaugh
(74) *Attorney, Agent, or Firm*—St. Onge Steward Johnston & Reens LLC

(57) ABSTRACT

A heel surface element for a bowling shoe has a body defining an upper, attachment surface for attachment of the heel surface element upon a heel region of a bowling shoe and a lower, heel surface having a horseshoe-shape surface disposed for engagement upon a bowling alley approach surface during bowling motion and center region surface spaced from contact with the bowling alley approach surface. The center region surface is defined peripherally by the horseshoe-shape surface and extends from a heel front edge towards a heel rear edge. The horseshoe-shape surface tapers from a front thickness in a region adjacent the heel front edge to a second, relatively greater thickness in a region adjacent the heel rear edge. The heel front edge defines a notch extending toward the heel rear edge. The center region surface narrows, curving inwardly from the heel front edge toward the heel rear edge. Each of the heel surface and the horseshoe-shape surface has a rounded front or leading edge. Also described is a bowling shoe with a heel having a heel surface as described above, the heel surface being defined by a fixed heel or by a removable heel surface element.

18 Claims, 2 Drawing Sheets

U.S. PATENT DOCUMENTS

| | | | | | |
|---|---|---|---|---|---|
| 3,074,184 | A | | 1/1963 | Litak | |
| 3,195,244 | A | | 7/1965 | Whitcas | |
| 3,318,025 | A | | 5/1967 | Antelo | |
| 3,478,447 | A | | 11/1969 | Gillead | |
| 3,526,976 | A | | 9/1970 | Jacobs | |
| 3,538,626 | A | | 11/1970 | Einstein, Jr. | |
| 3,672,077 | A | | 6/1972 | Coles | |
| 4,214,384 | A | | 7/1980 | Gonzalez R. | |
| 4,351,120 | A | | 9/1982 | Dalebout | |
| 4,377,042 | A | | 3/1983 | Bauer | |
| 4,445,285 | A | | 5/1984 | Phillips | |
| 4,530,173 | A | * | 7/1985 | Jesinsky, Jr. | 36/92 |
| 4,551,930 | A | | 11/1985 | Graham et al. | |
| 4,716,664 | A | | 1/1988 | Taylor | |
| D326,954 | S | | 6/1992 | Kiyosawa et al. | |
| 5,542,198 | A | | 8/1996 | Famolare | |
| 5,598,645 | A | * | 2/1997 | Kaiser | 36/29 |
| 5,901,467 | A | * | 5/1999 | Peterson et al. | 36/29 |
| 6,233,846 | B1 | * | 5/2001 | Sordi | 36/28 |

* cited by examiner

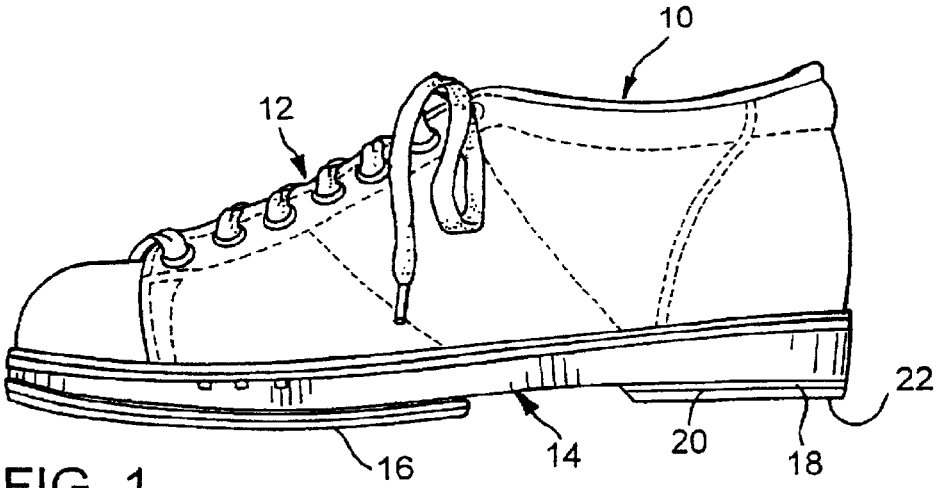
FIG. 1
FIG. 1A
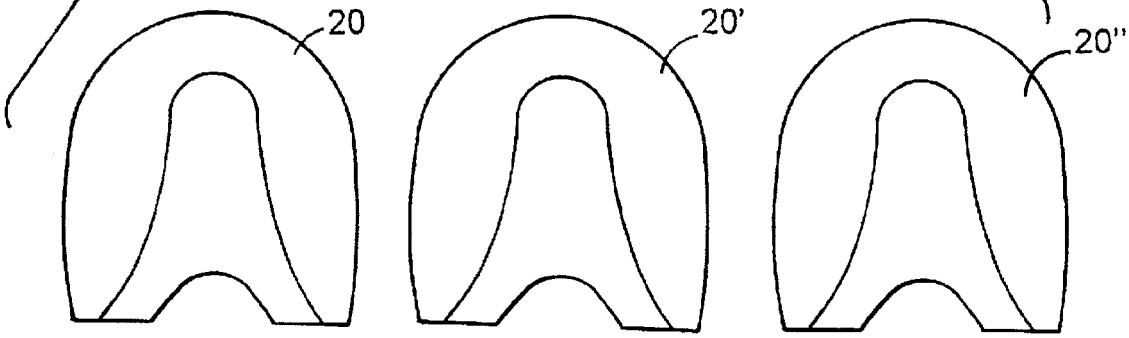
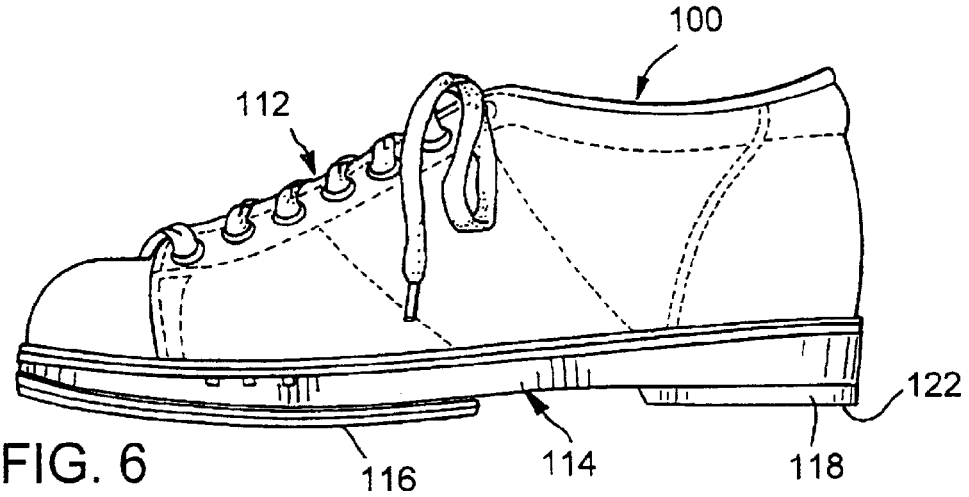
FIG. 6

HORSESHOE-SHAPE BOWLING SHOE HEEL

This application claims benefit of U.S. Provisional application 60/257,812 filed Dec. 21, 2000,

TECHNICAL FIELD

This invention relates to bowling shoes, and more particularly to heel surfaces and removable heel surface elements for bowling shoes.

BACKGROUND

Bowlers may desire bowling shoes with fore sole and/or heel surfaces of differing configuration and sliding, i.e., coefficient of friction, and other performance characteristics, e.g., in response to variations in bowling alley approach surfaces. The concept of bowling shoes with removable fore sole and heel surface elements of different configurations and performance characteristics is described, e.g., in Famolare U.S. Pat. No. 5,542,198.

SUMMARY

According to one aspect of the invention, a heel surface element for a bowling shoe comprises a body defining an upper, attachment surface for attachment of the heel surface element upon a heel region of a bowling shoe and a lower, heel surface, the heel surface comprising a horseshoe-shape surface disposed for engagement upon a bowling alley approach surface during bowling motion and a center region surface spaced from contact with the bowling alley approach surface, the center region surface being defined peripherally by the horseshoe-shape surface and extending from a heel front edge towards a heel rear edge.

Preferred embodiments of the invention may include one or more of the following additional features, alone or in any of several different combinations. The horseshoe-shape surface tapers from a front thickness in a region adjacent the heel front edge to a second, relatively greater thickness in a region adjacent the heel rear edge. The heel front edge defines a notch extending toward the heel rear edge. Each of the heel surface and/or the horseshoe-shape surface has a rounded front or leading edge. The center region surface narrows inwardly, e.g., curvedly inwardly, from the heel front edge toward the heel rear edge.

According to another aspect of the invention, a heel surface element for a bowling shoe comprises a body defining an upper, attachment surface for attachment of the heel surface element upon a heel region of a bowling shoe and a lower, heel surface, the heel surface comprising: a horseshoe-shape surface disposed for engagement upon a bowling alley approach surface during bowling motion and a center region surface spaced from contact with the bowling approach surface, the center region surface being defined by the horseshoe-shape surface and extending from a heel front edge towards a heel rear edge. The horseshoe-shape surface tapers from a front thickness in a region adjacent the heel front edge to a second, relatively greater thickness in a region adjacent the heel rear edge. The heel front edge defines a notch extending toward the heel rear edge. The center region surface narrows curvedly inwardly from the heel front edge toward the heel rear edge. Each of the heel surface and the horseshoe-shape surface each has a rounded front or leading edge.

According to another aspect of the invention, a bowling shoe has a heel defining a lower heel surface, as described above. The heel may be fixedly or removably attached upon the shoe.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 1 is a perspective view of a bowling shoe with a removable heel surface element of the invention;

FIG. 1A is a bottom plan view of a set of removable heel surface elements of the invention;

FIG. 6 is a perspective view of another embodiment of a bowling shoe having a fixedly mounted heel with a heel surface of the invention.

Like reference symbols in the various drawings indicate like elements.

DETAILED DESCRIPTION

Figure 4:
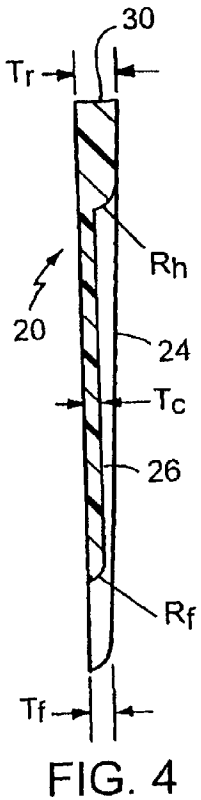
FIG. 4 is a side section view of a heel surface element of the invention, taken at the line 4—4 of FIG. 2.
Figure 2:
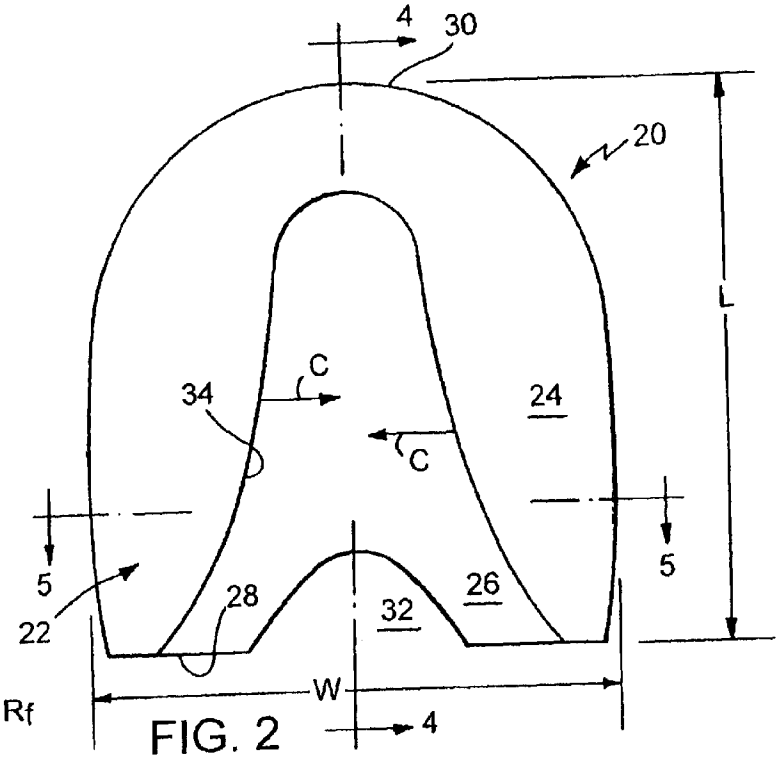
FIG. 2 is a bottom plan view of a heel surface element of FIGS. 1 and 1A.

Referring to FIG. 1, bowling shoe 10 has an upper 12 and an outsole 14, the outsole having a fore sole 16 and a heel 18. Referring now also to FIGS. 2–5, in a preferred embodiment of the invention, the heel 18 includes a heel surface element 20 that is removably attached in a manner to permit, e.g., a bowler, to selectively attach heel surface elements 20, 20', 20" (FIG. 1A) of different performance characteristics, e.g., coefficient of friction. The heel surface element 20 may be formed of any suitable material, including rubber, and polymeric material, formulated in a manner known to those skilled in the art to provide desired performance and other characteristics. One such suitable material is GOODYEAR®GOLD. In the preferred embodiment, the heel surface element has a width, W, e.g., about 103.3 mm. and an overall front-to-back length, L, e.g., about 100 mm. The concept of sets of removable heel surface elements and/or fore soles of different characteristics is described, e.g., in Famolare U.S. Pat. No. 5,542,198, the complete disclosure of which is incorporated herein by reference.

Referring still to FIGS. 1–5, the heel surface element 20 defines a heel surface 22 having a horseshoe-shape surface 24 disposed for engagement upon a bowling alley approach surface, A, during bowling motion and a center region surface 26 spaced from contact with the bowling alley approach surface. The center region surface is defined peripherally by the horseshoe-shape surface and extends from a heel front edge 28 towards a heel rear edge 30. The horseshoe-shape surface 24 tapers, at angle, H, e.g. about 2°, from a thickness, $T_f$, e.g., about 4.8 mm, in a region adjacent the heel front edge 28, to a second, relatively greater thickness, $T_r$, e.g. about 8.0 mm, in a region adjacent the heel rear edge 30. The heel front edge 28 defines a notch 32, e.g., about 35.2 mm wide at its opening and extending toward the heel rear edge 30 to a depth, e.g., of about 15.9 mm. The center region surface 26 is generally flat, with a body thickness, e.g., of about 3.2 mm, and narrows curvedly inwardly (arrows, C) from the heel front edge 28 towards the heel rear edge 30. The front or leading edge 28 of the heel is rounded at a radius, $R_f$, e.g., about 6.0 mm, including within the notch 32, and the front or leading edge 34 of the horseshoe-shape surface 24 is rounded at a radius, $R_h$, e.g., also about 6.0 mm.

In the preferred embodiment of FIG. 1, the heel surface element 20 has a VELCRO®-type loop upper surface 36 for releasable attachment to an opposed VELCRO®-type hook surface of the heel 18 of bowling shoe 10 (FIG. 1 ), to allow selective use of heels from a set of heel surface elements 20, 20', 20' (FIG. 1A) of different coefficients of friction or other performance characteristics. Heel surface elements 20 of different coefficient of friction characteristics in a set may be color-coded, e.g., a slide surface of lower coefficient of friction may be colored green while a brake surface of relatively greater coefficient of friction may be colored red.

Figure 3:
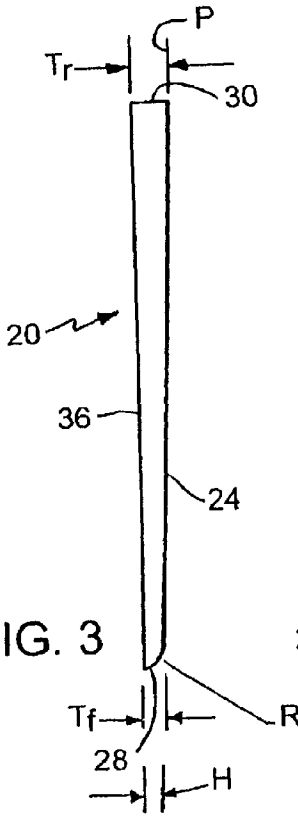
FIG. 3 is a side view of a heel surface element of FIGS. 1 and 1A.
Figure 5:
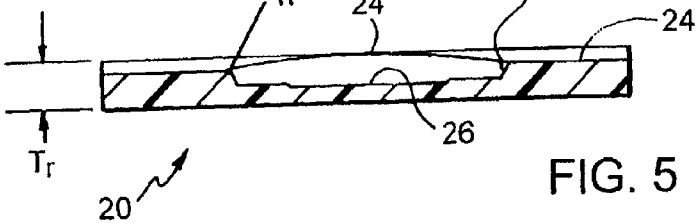
FIG. 5 is a front section view of a heel surface element of the invention, taken at the line 5—5 of FIG. 2.

Referring again to FIG. 1, in a typical bowling shoe 10, the fore sole region 16 has a slide (low friction) sole surface 40 and the heel 18 has a slide (lower friction) or brake (higher friction) surface 22. According to the invention, the configuration of the heel surface 22 places the horseshoe-shape surface 24 in position to contact the bowling alley approach surface, A, and shifts the effective leading edge 34 of the heel surface contacting the bowling alley approach surface, i.e., the leading edge 34 of the horseshoe-shape surface 24, rearward, towards the heel rear edge 30 at the back of the bowler's foot, for smoother transition from fore sole slide surface 40 to heel surface 22, during bowling motion. The v-shape notch 32 formed in the front or leading edge 28 of the heel surface element 20 reduces or eliminates leading edge contact with the bowling alley approach surface, A, in front of the heel horseshoe-shape surface 24, thereby to lessen or eliminate front edge drag. Rounded edges 28, 34 of the heel front or leading edge 28 and the horseshoe-shape surface leading edge 34, respectively, provide smoother transition across the front or leading edge 28 of the heel surface element 20 and across the leading edge 34 onto the horseshoe-shape surface 24, to avoid chatter, e.g., when a heel brake surface is applied. The tapering wedge shape of the horseshoe-shape surface 24 (at angle, H) allows the horseshoe-shape surface to lay flat on the bowling alley approach surface (plane, P; FIG. 3), from front to back, e.g., for better weight distribution and better braking effect at the appropriate time during bowling motion. Curved inward narrowing of the center region surface 26 (arrows, C) provides smoother transition and reduced chatter, e.g., when braking, and allows the horseshoe-shape surface 24 to lay flat upon the bowling alley approach surface, A, e.g., for better weight distribution and braking effect during bowling motion.

Alternatively, referring to FIG. 6, in another embodiment of the invention, a bowling shoe 100 has an upper 112 and an outsole 114, the outsole having a fore sole 116 and a heel 118. In this embodiment, the heel 118, defining a heel surface 122 of the invention, is fixedly mounted.

A number of embodiments of the invention have been described. Nevertheless, it will be understood that various modifications may be made without departing from the spirit and scope of the invention. For example, different heel surface elements may exhibit one or a combination of performance characteristics in addition to or other than coefficient of friction. Accordingly, other embodiments are within the scope of the following claims.

What is claimed is:

1. A shoe with a heel having a heel surface disposed for engagement upon a bowling alley approach surface during bowling motion, said heel surface comprising a horseshoe-shape surface disposed for engagement upon a bowling alley approach surface during bowling motion and a center region surface connecting at least two localized areas of said horseshoe-shape surface together and being spaced from contact with the bowling alley approach surface, said center region surface being defined peripherally by said horseshoe-shape surface and extending from a heel front edge towards a heel rear edge; said heel surface being removably mounted to the bowling shoe, wherein said heel front edge defines a notch extending toward said heel rear edge, and wherein said heel surface element has a rounded front or leading edge.

2. The heel surface element for a bowling shoe of claim 1, wherein said center region surface narrows inwardly from said heel front edge toward said heel rear edge, and wherein said heel surface element has a rounded front or leading edge.

3. The heel surface element for a bowling shoe of claim 1, wherein said center region surface narrows inwardly from said heel front edge toward said heel rear edge, and wherein said heel surface element has a rounded front or leading edge and said horseshoe-shape surface has a rounded front or leading edge.

4. The heel surface element for a bowling shoe of claim 1, wherein said heel surface element has a rounded front or leading edge and said horse-shoe-shape surface has a rounded front or leading edge.

5. A shoe with a heel having a heel surface disposed for engagement upon a bowling alley approach surface during bowling motion, said heel surface comprising a horseshoe-shape surface disposed for engagement upon a bowling alley approach surface during bowling motion and a center region surface connecting at least two localized areas of said horseshoe-shape surface together and being spaced from contact with the bowling alley approach surface, said center region surface being defined peripherally by said horseshoe-shape surface and extending from a heel front edge towards a heel rear edge; said heel surface being removably mounted to the bowling shoe, wherein said heel front edge defines a notch extending toward said heel rear edge, and wherein said horseshoe-shape surface has a rounded front or leading edge.

6. The horseshoe-shape surface for a bowling shoe of claim 5, wherein said center region surface narrows inwardly from said heel front edge toward said heel rear edge, and wherein said horseshoe-shape surface has a rounded front or leading edge.

7. A shoe with a heel having a heel surface disposed for engagement upon a bowling alley approach surface during bowling motion, said heel surface comprising a horseshoe-shape surface disposed for engagement upon a bowling alley approach surface during bowling motion and a center region surface connecting at least two localized areas of said horseshoe-shape surface together and being spaced from contact with the bowling alley approach surface, said center region surface being defined peripherally by said horseshoe-shape surface and extending from a heel front edge towards a heel rear edge; said heel surface being removably mounted to the bowling shoe, wherein said heel surface element has a rounded front or leading edge.

8. The heel surface element for a bowling shoe of claim 7, wherein said heel surface element has a rounded front or leading edge and said horseshoe-shape surface has a rounded front or leading edge.

9. A shoe with a heel having a heel surface disposed for engagement upon a bowling alley approach surface during bowling motion, said heel surface comprising a horse-shoe-shape surface disposed for engagement upon a bowling alley approach surface during bowling motion and a center region surface connecting at least two localized areas of said horse-shoe-shape surface together and being spaced from contact with the bowling alley approach surface, said center region surface being defined peripherally by said horseshoe-shape surface and extending from a heel front edge towards a heel rear edge; said heel surface being removably mounted to the bowling shoe, wherein said horseshoe-shape surface has a rounded front or leading edge.

10. A shoe with a heel having a heel surface disposed for engagement upon a bowling alley approach surface during bowling motion, said heel surface comprising a horseshoe-shape surface disposed for engagement upon a bowling alley approach surface during bowling motion and a center region surface connecting at least two localized areas of said horseshoe-shape surface together and being spaced from contact with the bowling alley approach surface, said center region surface being defined peripherally by said horseshoe-shape surface and extending from a heel front edge towards a heel rear edge; said heel surface being removably mounted to the bowling shoe, wherein said center region surface narrows inwardly from said heel front edge toward aid heel rear edge, wherein said heel surface element has a rounded front or leading edge.

11. A shoe with a heel having a heel surface disposed for engagement upon a bowling alley approach surface during bowling motion, said heel surface comprising a horseshoe-shape surface disposed for engagement upon a bowling alley approach surface during bowling motion and a center region surface connecting at least two localized areas of said horseshoe-shape surface together and being spaced from contact with the bowling alley approach surface, said center region surface being defined perioherally by said horseshoe-shape surface and extending from a heel front edge towards a heel rear edge; said heel surface being removably mounted to the bowling shoe, wherein said center region surface narrows inwardly from said heel front edge toward paid heel rear edge, and wherein said horseshoe-shape surface has a rounded front or leading edge, wherein said horseshoe-shape surface has a rounded front or leading edge.

12. A shoe with a heel having a heel surface disposed for engagement upon a bowling alley approach surface during bowling motion, said heel surface comprising a horseshoe-shape surface disposed for engagement upon a bowling alley approach surface during bowling motion and a center region surface connecting at least two localized areas of said horseshoe-shape surface together and being spaced from contact with the bowling alley approach surface, said center region surface being defined peripherally by said horseshoe-shape surface and extending from a heel front edge towards a heel rear edge; said heel surface being removably mounted to the bowling shoe, wherein said center region surface narrows curvedly, and wherein said heel surface element has a rounded front or leading edge and said horseshoe-shape surface has a rounded front or leading edge.

13. A shoe with a heel having a heel surface disposed for engagement upon a bowling alley approach surface during bowling motion, said heel surface comprising a horseshoe-shape surface disposed for engagement upon a bowling alley approach surface during bowling motion and a center region surface connecting at least two localized areas of said horseshoe-shape surface together and being spaced from contact with the bowling alley approach surface, said center region surface being defined peripherally by said horseshoe-shape surface and extending from a heel front edge towards a heel rear edge; said heel surface being removably mounted to the bowling shoe, and wherein said heel surface has a rounded front or leading edge ad said horseshoe-shape surface has a rounded front or leading edge.

14. A shoe with a heel having a heel surface disposed for engagement upon a bowling alley approach surface during bowling motion, said heel surface comprising a horseshoe-shape surface disposed for engagement upon a bowling alley approach surface during bowling motion and a center region surface connecting at least two localized areas of said horseshoe-shape surface together and being spaced from contact with the bowling alley approach surface, said center region surface being defined peripherally by said horseshoe-shape surface and extending from a heel front edge towards a heel rear edge; said heel surface being removably mounted to the bowling shoe, wherein said center region surface narrows inwardly from said heel front edge toward said heel rear edge, wherein said heel surface has a rounded front or leading edge.

15. A shoe with a heel having a heel surface disposed for engagement upon a bowling alley approach surface during bowling motion, said heel surface comprising a horseshoe-shape surface disposed for engagement upon a bowling alley approach surface during bowling motion and a center region surface connecting at least two localized areas of said horseshoe-shape surface together and being spaced from contact with the bowling alley approach surface, said center region surface being defined peripherally by said horseshoe-shape surface and extending from a heel front edge towards a heel rear edge; said heel surface being removably mounted to the bowling shoe, wherein said center region surface surface narrows inwardly from said heel front edge toward said heel rear edge, and wherein said horseshoe-shape surface has a rounded front or leading edge.

16. A shoe with a heel having a heel surface disposed for engagement upon a bowling alley approach surface during bowling motion, said heel surface comprising a horseshoe-shape surface disposed for engagement upon a bowling alley approach surface during bowling motion and a center region surface connecting at least two localized areas of said horseshoe-shape surface together and being spaced from contact with the bowling alley approach surface, said center region surface being defined peripherally by said horseshoe-shape surface and extending from a heel front edge towards a heel rear edge; said heel surface being removably mounted to the bowling shoe, wherein said center region surface surface narrows inwardly from said heel front edge toward said heel rear edge, wherein said center region surface narrows curvedly, and wherein said heel surface has a rounded front or leading edge and said horseshoe-shape surface has a rounded front or leading edge.

17. A shoe with a heel having a heel surface disposed for engagement upon a bowling alley approach surface during bowling motion, said heel surface comprising; a horseshoe-shape surface disposed for engagement upon a bowling alley approach surface during bowling motion and a center region surface connecting at least two localized areas of said horseshoe-shape surface together and being spaced from contact with the bowling alley approach surface, said center region surface being edge towards a heel rear edge; said heel surface being removably mounted to the bowling shoe; said horseshoe-shape surface tapering from a front thickness in a region adjacent said heel front edge to a second, relatively greater rear thickness in a region adjacent said heel rear edge; said heel front edge defining a notch extending toward said heel rear edge; said center region surface narrowing curvedly inwardly from said heel front edge toward said heel rear edge; and said heel surface and said horseshoe-shape surface each having a rounded front or leading edge.

18. The bowling shoe of claim 17, wherein opposed surfaces of said heel and said heel surface define cooperating elements of a hook-and-loop type fastener system.

* * * * *